US005489051A

United States Patent [19]

Robinson

[11] Patent Number: 5,489,051

[45] Date of Patent: Feb. 6, 1996

[54] PAINTER'S POUCH

[76] Inventor: Carl D. Robinson, 6702 E. 17th St., Tulsa, Okla. 74112

[21] Appl. No.: 124,500

[22] Filed: Sep. 22, 1993

[51] Int. Cl.[6] ..... A45F 5/00

[52] U.S. Cl. ..... 224/148; 224/199; 224/253; 224/904; 224/907; 224/245; 224/249; 224/250; 224/901; 24/194; 292/150; 220/570; 220/697; 220/731; 206/373; 206/361

[58] Field of Search ..... 224/148, 199, 224/197, 901, 253, 904, 907, 249, 242, 245, 250; 206/372, 373, 377, 376, 379, 209, 361, 15.2, 229, 230; 220/570, 696, 697, 698, 695, 702, 731

[56] References Cited

U.S. PATENT DOCUMENTS

| | | | |
|---|---|---|---|
| 1,238,830 | 9/1917 | Schuster | 220/697 |
| 2,863,690 | 12/1958 | Lewin | 292/302 |
| 2,945,614 | 7/1960 | Wittmann, Sr. | 224/148 |
| 2,985,349 | 5/1961 | McGuire . | |
| 3,619,817 | 11/1971 | Rockwell | 224/245 |
| 3,887,103 | 6/1975 | Spooner | 206/373 |
| 3,893,725 | 7/1975 | Coulter et al. | 24/306 |
| 4,145,789 | 3/1979 | Morgan, Sr. | 220/570 |
| 4,159,838 | 7/1979 | Wilzig et al. | 292/150 |
| 4,172,542 | 10/1979 | Lankford | 224/148 |
| 4,325,503 | 4/1982 | Swinney | 224/148 |
| 4,363,433 | 12/1982 | Jaques | 224/253 |
| 4,433,801 | 2/1984 | Swinney | 224/148 |
| 4,527,720 | 7/1985 | Hayes | 224/148 |
| 4,746,042 | 5/1988 | King | 224/148 |
| 4,797,040 | 1/1989 | Hibbard | 206/379 |
| 4,865,282 | 9/1989 | Yonkman et al. | 220/697 |
| 5,005,710 | 4/1991 | Hofer | 206/373 |
| 5,016,791 | 5/1991 | Burow | 224/148 |
| 5,085,317 | 2/1992 | Jensen et al. | 220/410 |

FOREIGN PATENT DOCUMENTS

| | | | |
|---|---|---|---|
| 8300031 | 1/1983 | WIPO | 224/148 |

*Primary Examiner*—Linda J. Sholl

[57] ABSTRACT

A gravity responsive apparatus for the carriage of paint and paint application related tools suspended upon the hip of a painter which consists of a hip-supported, belt-attached base member which is flexibly attached by means of a separable ball and socket joint to a freely swinging sealable paint container and fitted tool carrier. Use of the device allows a painter to easily and safely scale ladders and scaffolds without danger of paint spillage and upon arrival at the place of application of paint to simply flip open and fold back the hinged, gasketed cover for access to the paint supply. A variety of painters preparation and application tools may be carried in the integral tool rack which is a part of the apparatus. The freely swinging construction allows the painter to assume almost any position without the probability of paint spillage or tool droppage and being fabricated of a smooth, seamless material, is readily cleanable and requires little care or maintenance.

4 Claims, 3 Drawing Sheets

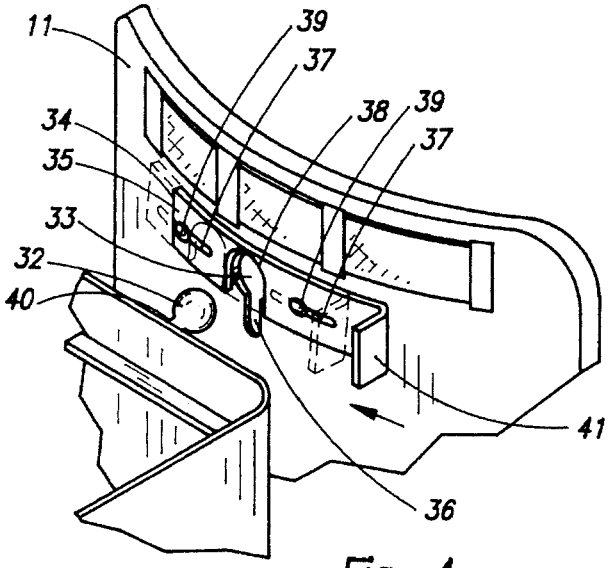
Fig. 4
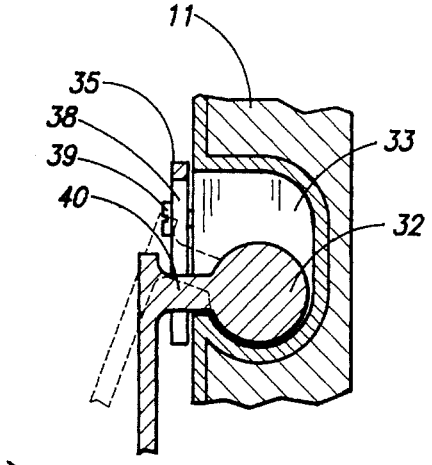
Fig. 5
Fig. 6
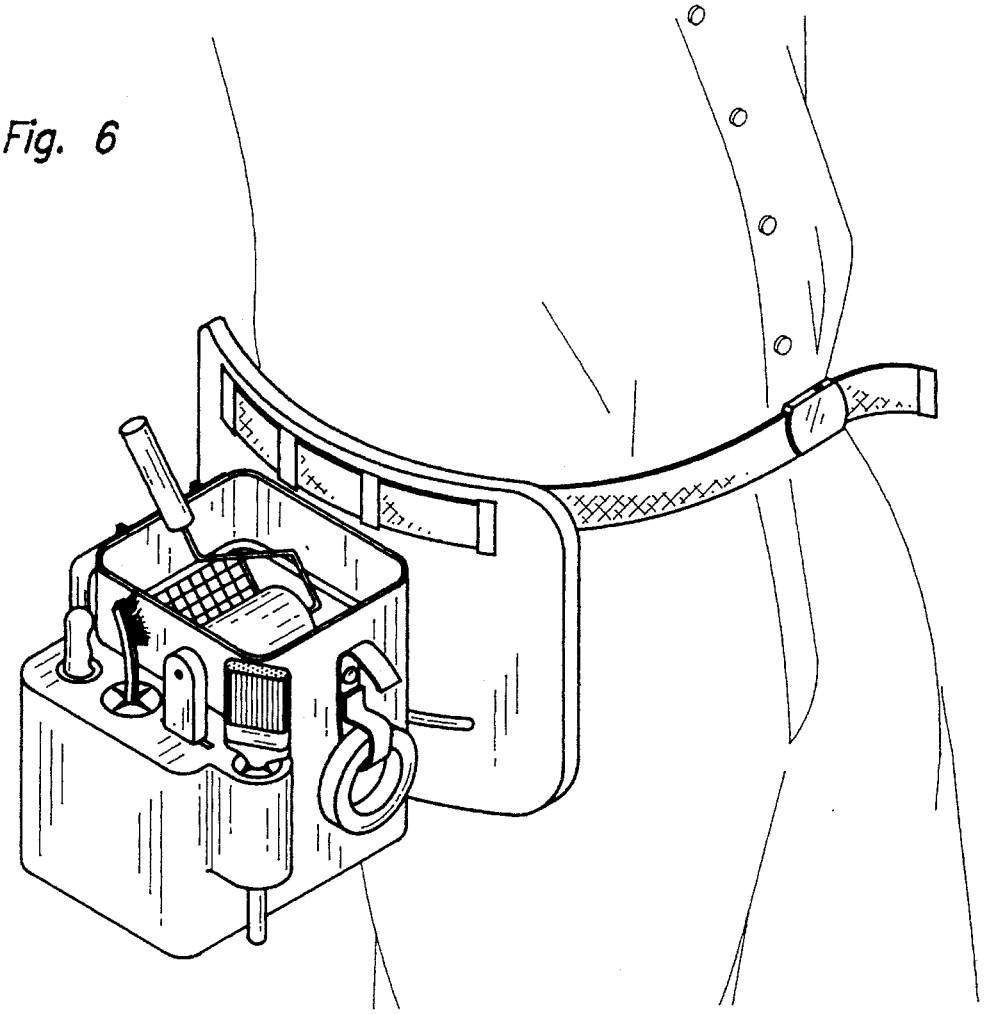

PAINTER' S POUCH

BACKGROUND OF THE INVENTION

In the field of painting and decorating, despite the technological advances that have been made in the rapid application of paints and stains to large areas by the employment of airless spray and pressurized roller technology, it is still necessary for the craftsman to apply paint to window sash and frames, doors, fascia, trim and difficult-to-reach areas by traditional brush and roller means. In order to accomplish coverage in these areas it is frequently necessary for the craftsman to assume awkward, uncomfortable and often dangerous positions on ladders, scaffolds, swing-staging, steeply pitched roofs and the like and employ the maximum reach provided by his or her arms to reach the difficult areas.

Unlike the carpenter who preceded, the painter is not afforded the luxury of dry, readily "pocketable" or "en-pouchable" tools. The very nature of the painters craft dictates that his tools be covered with paint in order to accomplish the job at-hand.

Also, unlike the carpenter, whose nails and screws may be readily carried in a pouch or nail apron with little likelihood of spillage and little damage done should a spill occur, the painter must carry his material in a liquid-containing pail or bucket, which must have an opening in the top thereof, to permit the frequently required re-loading of the paintbrush, while constantly attempting to maintain the paint pail or bucket in a near vertical position to prevent the spillage of a compound which, at best, is difficult and costly to remove and at worst, may require the employment of sophisticated aromatic solvent compounds which may have an adverse effect upon the environment.

Further, unlike nails which may fall to the ground and be easily collected and re-used, paint, once spilled is forever lost, thus placing the economic burden of material replacement upon the painter.

The painter faces an additional challenge when he must apply paint with a roller, as a means must be available to remove excess paint from the roller and distribute the paint in a substantially even coating upon the roller in order to make possible the even coating of the surface to be painted. This is generally accomplished by using a shallow, rectangular pan having a flat bottom portion which contains the paint supply and a tapered or slightly upwardly sloping bottom portion which is provided with a wire-like mesh or corrugations upon which the paint bearing roller may be rolled to remove excess paint and distribute the paint equally upon the roller. The use of such a pan is contingent upon a firm and level surface upon which it may be placed, a condition rarely found in the realm of the trim painter.

A last challenge faced by the trim or finish painter is that of carrying all the tools which will be needed to accomplish a complete painting operation without the requirement for constantly descending and re-ascending the ladder or scaffold to sequentially acquire the different tools required to finish the job, a task which may consume as much as twenty-five percent of the work-day and subjects the painter to additional exposure to the hazards associated with ladder and scaffold climbing.

Historically, as is reflected by the prior art, attempts have been made to make it easier for painters and others to carry materials and equipment attached to, or suspended from, the body of the user through the employment of various belts, harnesses and attachments and some progress has been made, though no commercial success or general usage of any of the earlier teachings is in evidence. Examples of these efforts, disclosed by the prior art, include the work of McGuire, who in U.S. Pat. No. 2,985,349 taught a "Painter's Pail and Brush Holster" for transporting a pail of paint and a single brush, attached to a holster-like device; Lankford, who devised a very complex "Paint Holder" which holds a paint container on an assembly which is worn in front of the user as was disclosed in U.S. Pat. No. 4,172,542; Swinney, who disclosed a "Painter's Belt-On Brush and Bucket Holder and Carrier" in U.S. Pat. No. 4,325,503, which carries a large paint bucket suspended from a belt-supported framework and; Hayes, who in U.S. Pat. No. 4,527,720 disclosed a belt-supported, hip-mounted device having a central rotational point.

It will be noted that, with only one exception, these examples of the prior art depend upon the semi-circular "bail" or wire handle of the paint container as the means of suspension of the paint container and the included weight of the paint therein. These handles, being of a relatively light-gauge wire, are easily bent or deformed and are subject to frequent failure at one or the other of their points of attachment to the sides of the container, resulting in the spillage of a large quantity of paint and the creation of the aforementioned spill-related problems.

OBJECT OF THE INVENTION

It is the object of the present invention to provide an improved apparatus or device for the carriage of a quantity of paint, as well as the tools and materials which are normally associated with the preparation of the surface to be painted and the application of the paint, in a more efficient and convenient manner. It is a further object of the invention to provide this convenience and efficiency in a device which has self-leveling and non-spill/non-slosh characteristics; is provided with a hinge-mounted sealable cover to prevent the incursion of extraneous or foreign matter and the excursion of paint; is provided with a "squeeze-out" screen to permit the use of a roller applicator; is readily detachable from a comfortably configured, belt-supported base member for convenient replenishment of paint supply or cleansing; is of a durable lightweight construction of readily cleanable material and; which may be economically produced to make it's features readily and affordably available to the painter, craftsman or homeowner.

BRIEF DESCRIPTION OF THE DRAWING FIGURES

FIG. 4 is an exploded detail view of the attachment and locking mechanism which joins the base member with the pouch or container member.

FIG. 5 is a sectionalized detail view through the ball and socket mounting employed between the base member and the container member and the locking mechanism also, depicting in phantom view the "swung-away" or displaced position the container member assumes when the craftsperson leans outwardly.

FIG. 6 is an overall view of the device as it appears when attached to the waist of the craftsperson when in use with the paint container or receptacle cover open and with tools and materials in their places of carriage and deposition, close-by the hand of the user.

THE PREFERRED EMBODIMENT OF THE INVENTION

The preferred embodiment of the present invention comprises a box-like paint container having a hinged, swing-away, sealable cover, and a tool and material holder and carrier which are adapted to be removably attached to a companion base member which is configured to rest comfortably in belted engagement upon the hip of a person engaged in surface preparation and the application of paint, having a number of features provided to enhance the convenience, efficiency and safety of the applicator. The two components of the present invention comprise ball and socket means for their conjoinment, said ball being held captive within said socket by a simple mechanical lock to prevent their inadvertent disengagement, while permitting the box-like portion to swing freely, forwardly, backwardly or outwardly without regard for the positioning of the body of the wearer, to maintain said box-like portion in an upright or vertical position.

Figure 1:
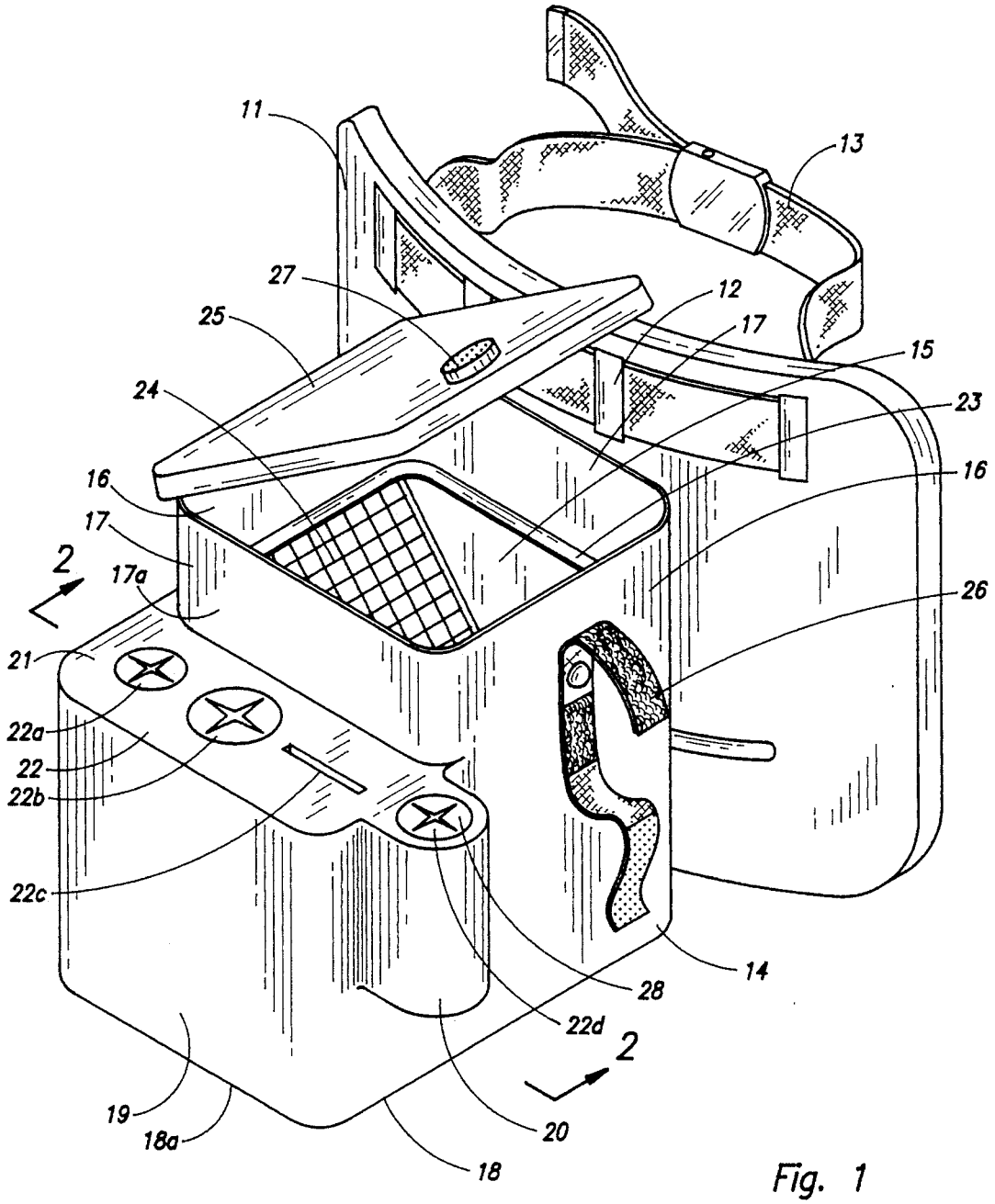
FIG. 1 is an overall isometric projection of the device illustrating the attachment of the support belt, the hip-supported mounting base, the paint container with cover in a partially closed position and the close-at-hand tool and material transport facilities.

Reference to the FIGURES OF THE DRAWINGS in conjunction with the following text will result in a complete and thorough understanding of the many features comprised in the reduction-to-practice of this invention wherein:

FIG. 1 illustrates the overall invention and will be seen to comprise a base member 11 which has proximate the upper perimeter thereof a plurality of integrally formed belt confining straps 12 through which there passes a conventional web or leather belt 13. Said belt 13 passes through openings provided for that purpose in the base member to encompass the waist of the user. Base member 11 has removably attached thereto a box-like member, generally designated as 14, comprising two contiguous yet distinct and functionally diverse compartments. Said compartments, being integrally formed, preferably of a thermo-setting plastic compound, share a common dividing wall 17*a* therebetween. The larger and deeper of the two compartments, serves as a paint container, hereinafter "paint well" 15, being of a substantially elongated cuboid configuration having two opposing panels 16 of equal width and two opposing panels 17 of a greater equal width, said four panels being joined by rounded corners to form a box-like construction having a top opening of a substantially rectangular configuration, having smoothly rounded corners. Said panels extend vertically downward to a point of conjoinment with a horizontal planar bottom panel 18 and 18*a* (not seen in this Figure), which is common to both compartments and are integrally joined therewith to form an impermeable box-like paint well 15, having substantially rectangular, longitudinal and lateral, vertical cross-sections. A second box-like compartment, hereinafter "tool box" 19, of a narrower and shorter configuration, integrally formed with and sharing common dividing wall 17*a* and common bottom panel 18*a* is situate the outboard face of paint well 15. Said tool box 19 also has, at the forward narrow edge thereof, a protuberant, turret-like portion 20 and is provided with an integrally formed or fixedly attached (dependent upon manufacturing techniques employed) top cover 21 having a plurality of various sized and shaped formed or cut openings 22*a, b, c* and *d* therein to accommodate the insertion of the various tools required by the painters craft and is hereinafter referenced as "tool rack" 22. The openings 22*a, b* and *d* in the top of tool rack 22 are provided with rubber-like fingers 28 which grip the handles or other portions of the inserted tools to prevent their excursion. Opening 22*c* is of a slot configuration to accommodate the blade of a putty knife or scraper. The interior of paint well 15 is provided, at a short distance below the top edge thereof, with a fixedly attached slosh-rail 23, of a substantially rectangular cross-section, which passes about the entire inner perimeter of paint well 15 and serves the triple purposes of 1) preventing movement-agitated paint from reaching the upper edge of the paint well, 2) providing a convenient edge (other than the top edge of the paint well) for the removal of excess paint from a brush and 3) retaining a paint roller "squeeze-out" screen 24 which diagonally traverses the paint well, downwardly from a point immediately subjacent slosh-rail 23, to the opposing conjunction of the paint well wall 16 and bottom panel 18, to provide a means for removing excess paint from a paint roller and more equally distributing the paint thereupon, thereby obviating the requirement for the presence of the time-honored "paint roller pan" upon the ladder or scaffold. The paint well 15 is provided with a hinged, over-lapping, sealable cover 25 (shown to advantage in following Figures) which may be tightly secured in a closed position by the engagement of the upper portion of hook-and-loop or "Velcro™" fastener strap 26, which is attached to the forward face 16 of paint well 15, by means of a rivet, with a corresponding fastener 27, which is adhesively attached to the top surface of sealable cover 25. A soft, rubber-like, sealing gasket 42 (FIG. 2) interposed between the inner surface of the sealable cover 25 and the upper edge of paint well 15 excludes air and conveniently provides a sealed container atmosphere in which the paint will not air-dry and/or "set-up" during short-term storage and by virtue of it's construction, obviates the requirement for tools to "pry open" the lid as is the case with conventional paint containers.

Figure 2:
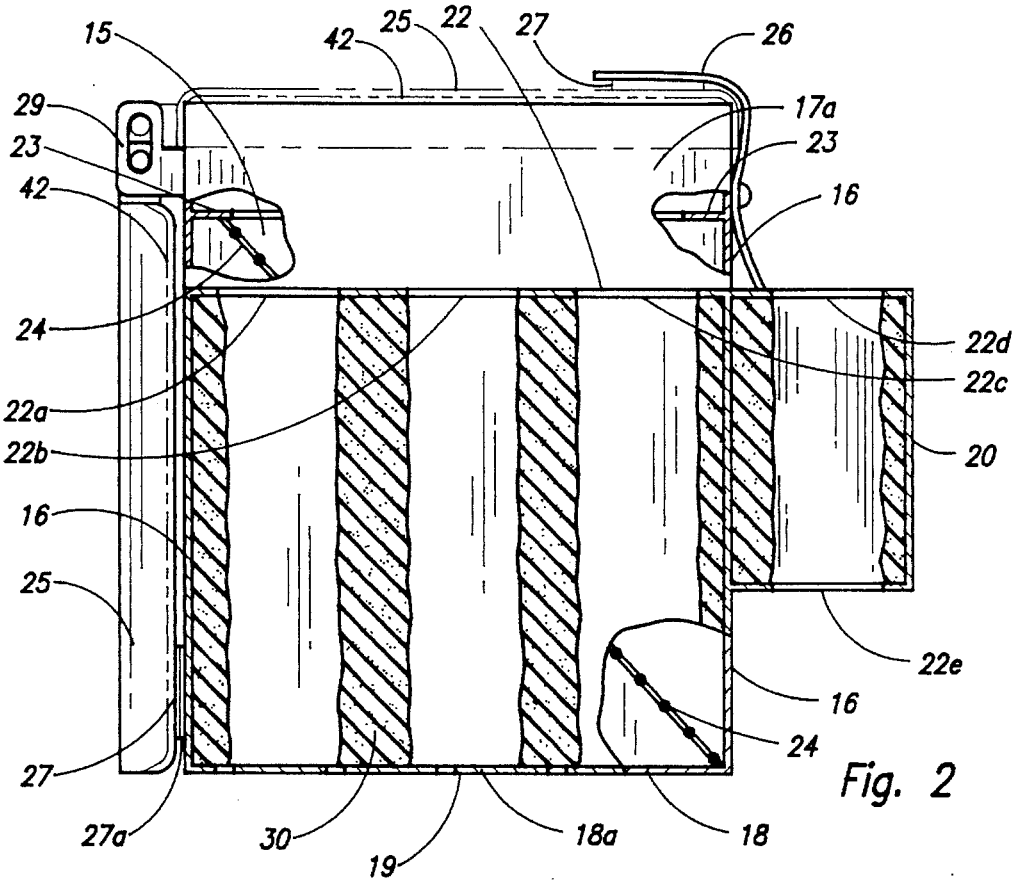
FIG. 2 is a partially cut-away end elevational view of the device of FIG. 1 taken at 2—2, viewed in the direction indicated by the arrows.

FIG. 2 illustrates, in partially cut-away end elevational view, the two box-like structures and shows to advantage the paint well cover 25, and the appurtenant slipjoint hinges 29 which retain the cover, allowing it to close tightly against a gasket 42 (in phantom view) or open fully and swing downward to lie flat against the side of the paint well wall 16 where it is closely retained by a (VELCRO)™. Velcro Industries brand of hook and loop fastener 27*a* in correspondence with fastener 27 which is also employed in conjunction with fastener 26 for sealing the paint well when the cover is in the closed position. Also shown to advantage in this Figure is the diagonally descending paint roller "squeeze-out" screen 24 which passes from subjacency to slop-rail 23 to the lower opposing corner of the paint well 15 at the juncture of wall panel 16 and bottom panel 18. A polystyrene or similar foam liner 30 is provided in tool box 19 in cooperation with openings 22*a, b, c* and *d* of tool rack 22 for the purpose of holding the inserted tools in an erect position. It should be noted that turret-like portion 20 of tool box 19 which contains opening 22*d* in tool rack 22 also comprises an additional opening 22*e* in the floor thereof to accommodate the longer handles of some paint brushes and allow the handles to pass completely through this section and extend downwardly through the bottom thereof in order that the brush not stand objectionably high in the tool rack as would be the case were this opening not provided.

Figure 3:
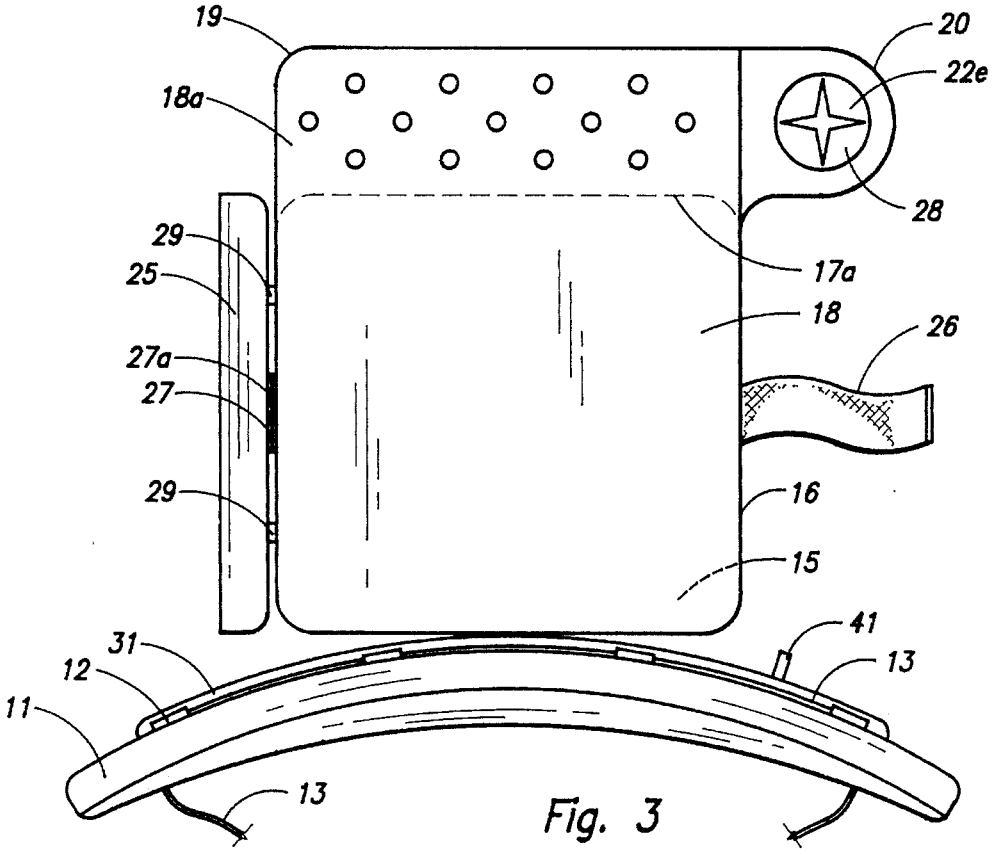
FIG. 3 is an inverted plan view of the device.

FIG. 3 which is a bottom view of the present invention illustrates the bottom panel 18 which is common to both the paint well 15 and the tool box 19 and depicts a perforate area 18*a* which is provided to allow the passage of small chip-like particles which may be introduced to the tool rack and box by tools following their use and to allow the passage of air to aid in drying the box after cleaning. A secondary set of rubber-like fingers 28 is also provided in the lower opening 22*e* of the turret-like portion 20 to stabilize the longer handled brushes which may pass therethrough. Also shown to advantage in this Figure is the lower portion of strap 26 which is provided with corresponding (VELCRO)™. Velcro Industries brand of hook and loop fasteners to allow the encirclement, through the core, of a roll of masking tape for its retention conveniently close-at-hand and the padded hip-borne base member 11, belt confining straps 12, belt 13 and a (TEFLON)™. DuPont brand of polytetrafluorethylene synthetic resin rub-rail 31 which permits near drag-free rotation fore and aft when the painter's body is vertical. A corresponding rub-rail could also be placed on the side of the paint containing member to prevent wear and further reduce friction at this point, however, many months of testing of the prototype have failed to indicate such a requirement. The location of the hereinafter described sliding lock mechanism operating tab 41 is also depicted in this illustration.

FIGS. 4 and 5 provide details of the manner in which a modified ball and socket joint comprising a separable ball 32 and a modified socket 33 are locked together by a slide-lock mechanism generally designated as 34. Said ball 32 is substantially typical of those employed in conventional joints of this type and comprises a spherical mass 32 integrally formed with a connecting neck 40. In this instance the ball is illustrated as being cast integrally from the same material as that employed in the structure of the paint container, however, it may also be of a metallic construction adapted for attachment by a suitable threaded fastener. Socket 33 comprises a round bore of a slightly larger diameter than that of the ball 32, said bore comprising a slotted cut-out area 36, of a width slightly larger than the diameter of the neck 40 of ball 32, extending downwardly from the periphery of the bore 33 for a distance equal to that of the diameter of said ball 32. Thus configured, the ball 32 may be inserted through the bore of socket 33 and lowered to cause the entry of neck 40 into slotted cut-out area 36 where it is prevented from rearward departure by the greater dimension of the ball 32. Said lock mechanism 34 comprises an elongated metal strap 35 which is formed along the length or longitudinal dimension thereof in a slightly arcuate manner, said arc being correspondent with the arcuate outer face of base member 11. Said metal strap 35 comprises adjacent to, but not extending to the opposing ends thereof, a pair of identical longitudinal slots 37 of a length slightly in excess of the dimension of the bore of socket 33. Said metal strap 35 is provided, at a point proximate the mid-point of the length thereof, with a cut-out area 38, resembling the inverted letter "U", which extends upwardly from the lower edge of said strap to the approximate center of the width thereof. Thus configured said slide-lock mechanism 34 is installed by means of loosely fitting "pan" or "oval-head" screws, rivets or other suitable means 39 which pass through slots 37 and into base member 11 in such a manner as to permit the fore and aft sliding movement of strap 35, while maintaining said strap in close and frictionally retarded sliding engagement with the surface of base member 11 and the consequent movement of cut-out area 38 to cover and uncover socket bore 33 thus causing the blocking and unblocking of bore 33 as the lower edge of strap 35 narrowly passes over the neck 40 of ball 32 which rests in slotted area 36, obstructing the bore and preventing the departure of said ball 32. Strap 35 is provided at the forward end thereof with a short turned-out portion or tab 41, to facilitate manipulation of the sliding movement of the locking mechanism 34. Thus configured the lock mechanism 34 may be slid forward along slots 37 to open socket 33, and allow the passage of ball 32 and permit the entry of neck 40 into slot 36 whereupon said mechanism may be slid aft to close and block the passage and prevent unwanted departure or separation of the ball and socket. This combination causes the base member and the paint and tool containing member to cooperate to allow the free swinging capability of the invention which permits the paint containing and tool bearing portions of the device to remain vertical in response to gravitational force as the painter's body moves in various manners to accomplish his task. It will be readily seen that the ball and socket assembly, locked together by the sliding lock mechanism allows the painter to assume nearly any position, from stooping or bending to stretching vertically and leaning far to the right without the least possibility or danger of paint spillage or tool droppage. The only action which may not be performed by the painter, without compensatory adjustment, is leaning to the left, in which case it becomes necessary to rotate the entire assembly either to the front or to the left hip. If warranted by demand the box-like portion of the device could be produced in a reverse pattern to more conveniently accommodate the needs of left-handed individuals.

FIG. 6 is a self-explanatory depiction of the manner in which the "Painter's Pouch" is borne upon the person of the user. Complete with paint, tools, accessories and supplies the painter is prepared to approach the job-at-hand in a confident and safe manner, secure in the knowledge that all that is needed to successfully accomplish his task is close-by and convenient to his hand and that the counter-productive chore of a clean-up of spilled paint is a thing of the past.

USE OF THE INVENTION

The use of the invention is both simple and straightforward and requires no special skills or training. The base member is donned by placing the belt about the waist and adjusting the belt to a comfortable tension. The paint containing member may then be filled with the desired paint and the top cover may be closed and fastened. The necessary tools to accomplish the task at hand are selected and placed in the suitable compartments, the ball is fitted into the socket and the latch is slid into the locked position. The craftsman may then proceed to the work-site, open the hinged sealing cover, stow it in its open position and go about the business of application of the paint. When the paint supply is depleted, the paint container may be quickly removed for replenishment and re-installed, as above, or additional paint may simply be poured into the container paint well while the device remains on the hip of the painter.

The present invention, as herein disclosed, provides a new, novel, unique and definitive solution to longstanding problems faced by those in the painting and decorating communities by providing means to accomplish the more difficult painting tasks with greater ease and efficiency and does so with a device which; requires no special training or skills for its use; requires essentially no maintenance; is, by virtue of it's smooth, seamless construction readily and easily cleanable and; which may be produced and marketed at a price which is well within the means of the average craftsperson. Additionally, it addresses and solves previously unaddressed problems related to safety and the environment by reducing the number of ladder and scaffold scalings required and by virtue of it's readily operable and conveniently storable top cover, makes it possible to carry paint to difficult-to-reach areas with far less danger of spillage than has heretofore been achieved and lastly, allows the painter to select and employ the surface preparation or application tool best suited to the job from a readily accessable source and obviates the requirement for the paint pan for roller application of paint.

While there has herein been disclosed, described, illustrated and explained, the presently preferred embodiment of the present invention, it should be understood that such has been done for purposes of illustration only and that certain changes, alterations, modifications and improvements may be made thereto, within the scope of the appended claims.

What I claim is:

1. An apparatus for the carriage of a quantity of paint, tools and materials comprising:

a belt secured, hip supported mounting base member having a front surface and means for attaching said base member to a user;

a paint container having a rear surface;

means attached to said paint container for carrying tools:

a paint container cover;

means for hingingly attaching said paint container cover to said paint container;

means for pivotally conjoining said base member to said paint container;

a rub rail positioned on the front surface of said base member and contacting the rear surface of said paint container, said rub rail being formed from a material permitting drag free rotation and preventing wear between said base member and said paint container.

2. The apparatus of claim 1 wherein said means for pivotally conjoining said base to said paint container includes a ball and socket joint.

3. The apparatus of claim 2 wherein the ball and socket joint includes means for preventing disengagement of said container to said base member.

4. The apparatus of claim 3 wherein said means for preventing disengagement includes a sliding strap adapted to open or close a dimensioned circular bore of said ball and socket joint.

* * * * *

UNITED STATES PATENT AND TRADEMARK OFFICE

CERTIFICATE OF CORRECTION

PATENT NO. : 5,489,051

DATED : February 6, 1996

INVENTOR(S) : Carl D. Robison

It is certified that error appears in the above-identified patent and that said Letters Patent is hereby corrected as shown below:

On the title page, item [76] Inventor: "Carl D. Robinson" should read --Carl D. Robison-- as shown on the attached title page.

Signed and Sealed this

Fourth Day of June, 1996

*Attest:*

*Attesting Officer*

BRUCE LEHMAN

*Commissioner of Patents and Trademarks*

United States Patent [19]

Robison

[11] Patent Number: 5,489,051

[45] Date of Patent: Feb. 6, 1996

[54] PAINTER'S POUCH

[76] Inventor: Carl D. Robison, 6702 E. 17th St., Tulsa, Okla. 74112

[21] Appl. No.: 124,500

[22] Filed: Sep. 22, 1993

[51] Int. Cl.[6] ..... A45F 5/00

[52] U.S. Cl. ..... 224/148; 224/199; 224/253; 224/904; 224/907; 224/245; 224/249; 224/250; 224/901; 24/194; 292/150; 220/570; 220/697; 220/731; 206/373; 206/361

[58] Field of Search ..... 224/148, 199, 224/197, 901, 253, 904, 907, 249, 242, 245, 250; 206/372, 373, 377, 376, 379, 209, 361, 15.2, 229, 230; 220/570, 696, 697, 698, 695, 702, 731

[56] References Cited

U.S. PATENT DOCUMENTS

| | | | |
|---|---|---|---|
| 1,238,830 | 9/1917 | Schuster | 220/697 |
| 2,863,690 | 12/1958 | Lewin | 292/302 |
| 2,945,614 | 7/1960 | Wittmann, Sr. | 224/148 |
| 2,985,349 | 5/1961 | McGuire . | |
| 3,619,817 | 11/1971 | Rockwell | 224/245 |
| 3,887,103 | 6/1975 | Spooner | 206/373 |
| 3,893,725 | 7/1975 | Coulter et al. | 24/306 |
| 4,145,789 | 3/1979 | Morgan, Sr. | 220/570 |
| 4,159,838 | 7/1979 | Wilzig et al. | 292/150 |
| 4,172,542 | 10/1979 | Lankford | 224/148 |
| 4,325,503 | 4/1982 | Swinney | 224/148 |
| 4,363,433 | 12/1982 | Jaques | 224/253 |
| 4,433,801 | 2/1984 | Swinney | 224/148 |
| 4,527,720 | 7/1985 | Hayes | 224/148 |
| 4,746,042 | 5/1988 | King | 224/148 |
| 4,797,040 | 1/1989 | Hibbard | 206/379 |
| 4,865,282 | 9/1989 | Yonkman et al. | 220/697 |
| 5,005,710 | 4/1991 | Hofer | 206/373 |
| 5,016,791 | 5/1991 | Burow | 224/148 |
| 5,085,317 | 2/1992 | Jensen et al. | 220/410 |

FOREIGN PATENT DOCUMENTS

| | | | |
|---|---|---|---|
| 8300031 | 1/1983 | WIPO | 224/148 |

*Primary Examiner*—Linda J. Sholl

[57] ABSTRACT

A gravity responsive apparatus for the carriage of paint and paint application related tools suspended upon the hip of a painter which consists of a hip-supported, belt-attached base member which is flexibly attached by means of a separable ball and socket joint to a freely swinging sealable paint container and fitted tool carrier. Use of the device allows a painter to easily and safely scale ladders and scaffolds without danger of paint spillage and upon arrival at the place of application of paint to simply flip open and fold back the hinged, gasketed cover for access to the paint supply. A variety of painters preparation and application tools may be carried in the integral tool rack which is a part of the apparatus. The freely swinging construction allows the painter to assume almost any position without the probability of paint spillage or tool droppage and being fabricated of a smooth, seamless material, is readily cleanable and requires little care or maintenance.

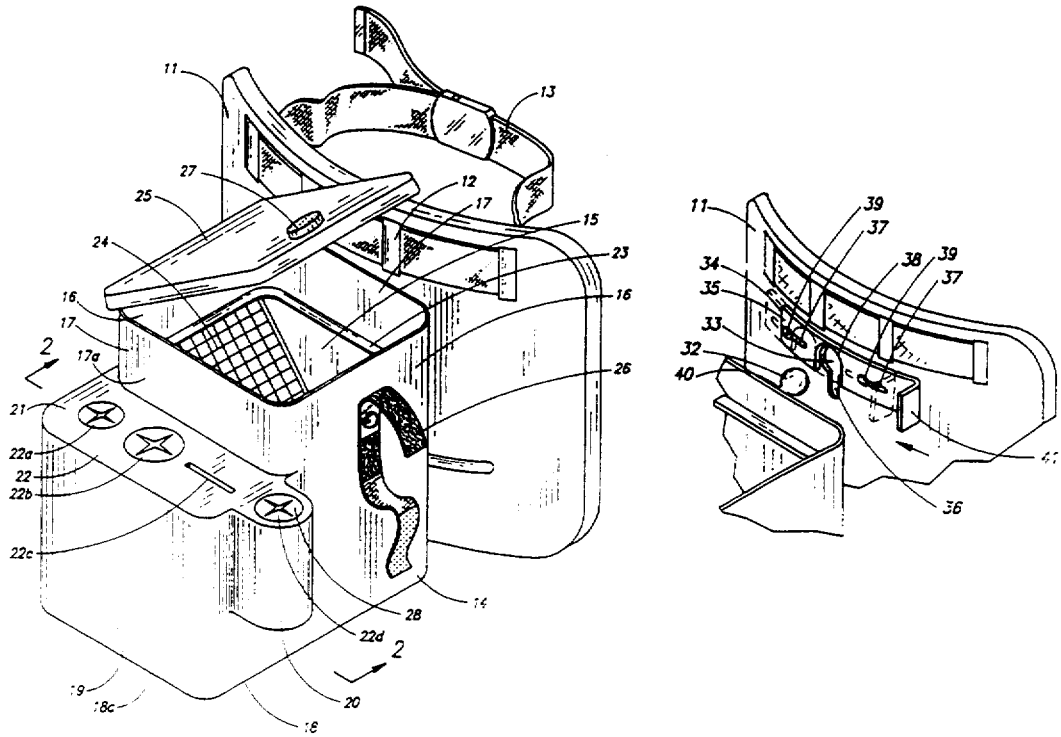

4 Claims, 3 Drawing Sheets